US006026594A

United States Patent [19]

Fougere

[11] Patent Number: 6,026,594

[45] Date of Patent: Feb. 22, 2000

[54] SKI BOOT WITH IMPROVED CLOSURE STRAP

[76] Inventor: Raymond Fougere, 52 Morton Ave., Newport, R.I. 02840

[21] Appl. No.: 09/100,737

[22] Filed: Jun. 19, 1998

[51] Int. Cl.[7] ..... A43B 5/04; A43C 11/00

[52] U.S. Cl. ..... 36/50.5; 36/50.1

[58] Field of Search ..... 36/50.5, 50.1

[56] References Cited

U.S. PATENT DOCUMENTS

| | | | |
|---|---|---|---|
| 4,258,482 | 3/1981 | Salomon . | |
| 5,007,186 | 4/1991 | Bischof et al. | 36/50.5 |
| 5,152,084 | 10/1992 | Bonnaventure | 36/50.5 |
| 5,651,197 | 7/1997 | James | 36/50.5 |
| 5,718,067 | 2/1998 | Ostiner . | |

*Primary Examiner*—M. D. Patterson
*Attorney, Agent, or Firm*—Andrew D. Maslow

[57] ABSTRACT

A ski or other similar sport boot is provided which includes a boot base for accommodating the foot of the wearer of the boot and a soft inner boot adapted to fit inside or on the boot base and surround the lower leg of the wearer of the boot. The boot also includes an upper cuff attached to the boot base. A closure strap for securing the upper cuff and inner bladder to the lower leg of the wearer of the boot is provided. The closure strap has a non-elastic band attached to an elastic portion. It also includes a securing means for adjusting the length of the non-elastic band and securely maintaining the adjusted length of the non-elastic band in a desired position.

17 Claims, 4 Drawing Sheets

SKI BOOT WITH IMPROVED CLOSURE STRAP

BACKGROUND OF THE INVENTION

1. Field of the Invention

The present invention relates to an improved flexible ski boot, or a similar type sport boot having a hard shell and soft inner liner, which allows for the boot to be flexed by the wearer by applying forward pressure via the lower leg to boot. When the boot is flexed and relaxed, a relatively constant pressure is applied by the boot to the lower leg of the wearer. The invention provides a strap, at least a part of which is elastic. The strap secures the boot to the lower leg of the wearer and may be attached to the boot or be separate from the boot. The sport boot, in addition to being a ski boot, can be for example, a hard shell boot used for roller or ice skates, a hard shell snowboard boot or a combination of a high back snowboard binding and soft snowboard boot.

2. Background of the Invention

During skiing the sole of the ski boot is rigidly connected to the ski by a ski binding. As a result, the ski boot acts as an interface between the ski and the lower leg of the skier. In order for the reaction of the ski on the surface of the snow to be transmitted immediately and accurately to the lower leg, and conversely, for the control exerted by the skier on the ski via the lower leg and the interface also to be transmitted immediately and accurately, the foot and lower leg must be held perfectly snug by the boot.

The ideal case would be for the boot to be integral with the foot and the lower leg. The portion of the boot surrounding the lower leg would then have to satisfy two incompatible requirements. On one hand, this portion of the boot would be extremely stiff so as to transmit as well as possible the forces exerted by the leg to the ski, and vice versa. On the other hand, the boot has to have sufficient flexibility for the boot to be opened, in order boot to be put on and taken off. Modern ski technique also requires that the wearer be able to feel the flexing of the boot. Various compromise solutions to this problem have been proposed to satisfy these two conflicting requirements. Most notably, high performance ski boots are provided with a non-elastic "power strap" which secures the boot to the lower leg of the wearer by use of a conventional Velcro (registered trademark) closure. Such strap is shown in U.S. Pat. No. 5,718,067. Conventional power straps tend to loosen during skiing after the initial tightening of the closure thereby becoming less effective.

Modern skiing and especially ski racing requires the skier to have excellent fore/aft balance during the turning of the ski. The construction of the ski boot plays a key role in allowing the skier or ski racer to maintain such balance. Forward pressure is applied to the front of the ski through the ski boot and bends the front of the ski more than the back. In high performance skiing or ski racing it is important that forward pressure be applied at the beginning of the turn. The turn finishes with neutral or aft pressure. Then the next turn is begun during which forward pressure is again applied to the front of the ski, and so on. All pressure is applied through the ski boot by the fore/aft movement of the skier's tibia against the ski boot. It is highly critical that the changes in fore/aft pressure be applied in a precise manner and thus any play in the fit of the ski boot in the area where the tibia meets the ski boot can cause a critical delay and subsequent loss of the skiers fore/aft balance.

Modern ski boots all include a soft, compressible inner boot liner enclosed in a hard outer shell. The conventional power strap tightens the upper cuff portion of the hard outer shell against the soft inner boot liner and the tibia of the wearer of the boot. When the ski boot is first put on the skier tightens and secures the power strap so that it puts pressure on the inner liner and compress it. Power straps adjusted to a fixed length tend to loosen during repetitive ski turns because the constant changing between forward and neutral or aft pressure tends to further compress the inner boot or loosen the Velcro fastener. If the power strap is loosened the skier no longer feels a constant pressure on the tibia and thus partially loses the feeling for the snow during critical portions of the turn. The instant invention enables the ski boot to apply a constant pressure to the tibia portion of the lower leg of the wearer throughout the turn even if the compression of the inner liner is increased, or the Velcro or similar type fastener loosens, after the boots are secured to the wearers feet and numerous linked skiing turns are completed.

Since human anatomy is vastly different from one individual to another it is unlikely the wearer will get a good boot fit, and therefore poor skiing characteristics of the boot will result, as the best fit gets the best response. In particular it is the voids and hollows that allow the leg or foot to move with respect to the boot i.e. boot slop. These voids and hollows create dead spots so when the skier exerts his or her muscles in attempts to articulate their joints there is no response from the ski. Also the harder shell even covered with foam on the inside may create pressure points which irritate the skier and lead to foot pain. It is also the nature of the construction of modern ski boots that tightening one part of the boot affects the fit and performance characteristics of the other section and the overall boot.

In the act of skiing it is the ski reacting to the skiers movements that determines the direction of travel of the ski-skier system. In this scenario it is the ski boot that transmits to the ski the muscle movements of the skier as forces, moments and couples. Specific to this invention it is the lever action of the upper cuff of the ski boot moving elastically in a forward direction that adds or redistributes a load to the front of the ski and integrated with other elements of skiing causes the ski to take a curved path and thereby allowing the skier to negotiate turns going down the hill. This loading of the ski tip elastically through the ski boot coupled with the forward movement lower leg is what, at least in part, allows the skier to stay in balance and to control the radius or tightness of the turn.

For a ski to operate as designed it needs, along with other elements of skiing, forward pressure applied to it by the skier through the upper cuff of the ski boot. This is accomplished by the skier using the upper cuff as a lever in the fore-aft direction, pushing the shaft of his leg forward against the front of the boot thereby applying pressure to the front of the ski. The control of this pressure with respect to the movement of the shaft of the leg is critical to the control of the turn. Ski boots as designed with a fixed geometry and elasticity will allow this to happen if the ski boot is perfectly fitting and the elasticity of the boot is exactly matched to the weight of the skier.

With any given geometry and elasticity of a ski boot a certain amount pressure on the front of the ski boot will allow a certain amount of deformation of the boot and will apply a certain amount of load to the ski tip. This must be done systematically throughout the turn for the skier to stay in balance. The application of pressure is therefore time sensitive. In present day ski boots as stated above there are voids and hollows and they can occur in the upper cuff area as well as anywhere in the boot. This invention eliminates this problem by bonding the lower leg to the upper cuff or what is known as the rear spoiler of the ski boot when the elastic member is preloaded. This eliminates all the slack or voids between the rear spoiler and the lower leg. Any forward movement of the leg will immediately translate to pressure on the front of the ski allowing the skier to easily control the turning of the ski. The hook and loop power strap provided with some ski boots does not produce this effect since it is not possible to obtain an elastic bond with hook and loop fasteners on inelastic straps. In high performance skiing it is desirable to allow this pressure to build up rapidly so a more rigid strap would be desirable. In recreational skiing however it is not necessary or desirable to have such a fast reacting ski, i.e. rigid ski boot. To accomplish this, the instant invention provides the elastic member with an adjusting mechanism to allow less preload of the elastic member thereby allowing more leg travel per given load thereby effectively softening the boot. This is analogous to the super tight steering of a race car compared to that of a common sedan with power steering.

The ski boots used in high performance skiing require fine tuning to maintain the skier's balance. Each person requires a slightly different boot. The skier's physical strength, speed at which the skier skis, the skiers body build and foot/lower leg shape all affect the way a boot works. Ideally boots must be matched to the skier. The instant invention provides and inexpensive means for matching the boot to the skier by changing the physical characteristics of the strap provided by the invention rather than the shell of the boot itself.

SUMMARY OF THE INVENTION

In the ski boot according to the invention the boot comprises a boot base for accommodating the foot, a soft inner bladder adapted to fit inside the boot base and surround the lower leg of the wearer of the boot, and an upper cuff attached to said boot base. The ski boot provides a closure strap for securing the upper cuff and inner bladder to the lower leg of the wearer of the boot. The strap has an elastic portion and a nonelastic band attached to the said elastic portion. The strap also includes a securing means for adjusting the length of the non-elastic band and securely maintaining the adjusted length of the non-elastic band in a desired position. The closure strap of the invention provides a self-adjusting means for applying a constant pressure to the lower leg of the wearer by applying constant pressure to the hinged upper cuff and the portion of the inner boot surrounding the lower leg of the wearer no matter how much said inner boot is compressed.

Still further the invention provides a method for securing a ski boot to the lower leg of the wearer by surrounding the upper cuff of the ski boot with a self-adjusting means for applying a constant pressure to the lower leg of the wearer by applying constant pressure to the upper cuff and the portion of the inner boot surrounding the lower leg of the wearer no matter how much said inner boot is compressed. Such self adjusting means may comprise a closure strap for securing the hinged upper cuff and inner bladder to the lower leg of the wearer of the boot wherein the strap consists of an elastic portion and a non-elastic band attached to said elastic portion. Securing means are provided for adjusting the length of the non-elastic band and securely maintaining the adjusted length of the non-elastic band in a desired position.

The object of the invention is to provide an improved support for the tibia portion of the lower leg of the wearer of a ski boot.

A further object of the invention is to provide a sport or ski boot which applies an constant pressure to the tibia portion of the lower leg of the wearer of the boot despite constant fore/aft pressure on the boot.

Another object of the invention is to provide an inexpensive means for adjusting a ski boot to the skiers physical strength, style of skiing and body build.

Yet another object of the invention is to provide a self adjusting strap for securing a ski or sport boot to the lower leg of the wearer of the boot.

Still another object of the invention is to provide a means to allow immediate application of pressure to the front of the ski regardless of the fit of the ski boot.

Another object of the invention is to control the skiing characteristics of the ski boot by adjusting the preload in an elastic member of a strap applying a constant pressure to the tibia of the wearer.

A still further object of the invention is to provide a means to lessen the likelihood of soreness of the tibia portion of the lower leg commonly caused by the leg bumping up against the hard shell of the ski boot.

Another object of the invention is to provide a power strap which maintains a constant pressure on the lower leg of the wearer even if the strap is loosened as a result of forces applied to the power strap by the skier.

Still other objects and advantages of the invention will in part be apparent from the specification.

The invention accordingly comprises the features of construction, combination of elements and arrangement of parts which will be exemplified in the construction hereinafter set forth and the scope of the invention will be indicated in the claims.

DETAILED DESCRIPTION OF THE DRAWING

Figure 1:
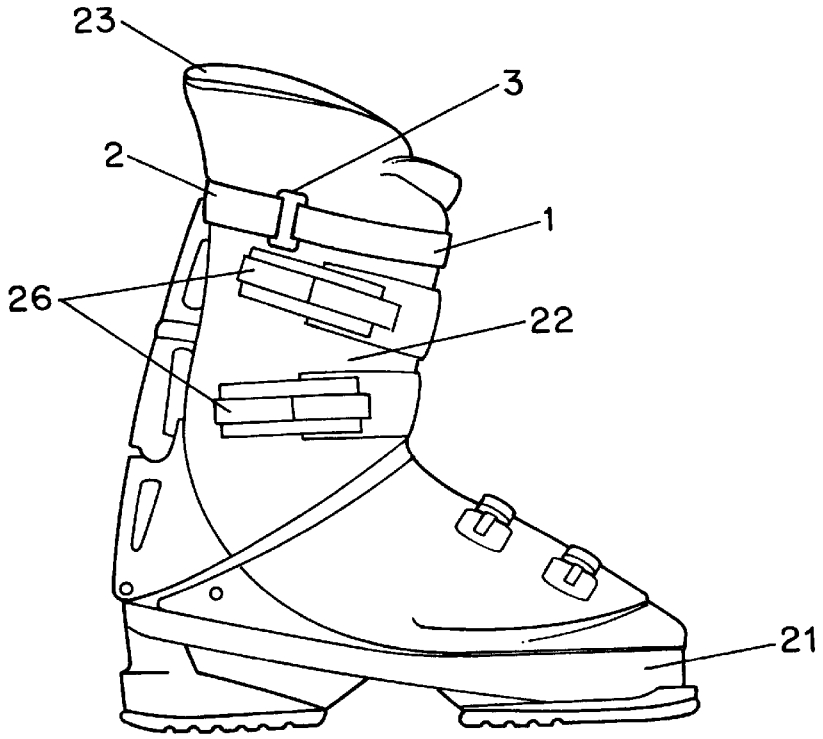
FIG. 1 is a right side view of the ski boot of the invention.
Figure 2:
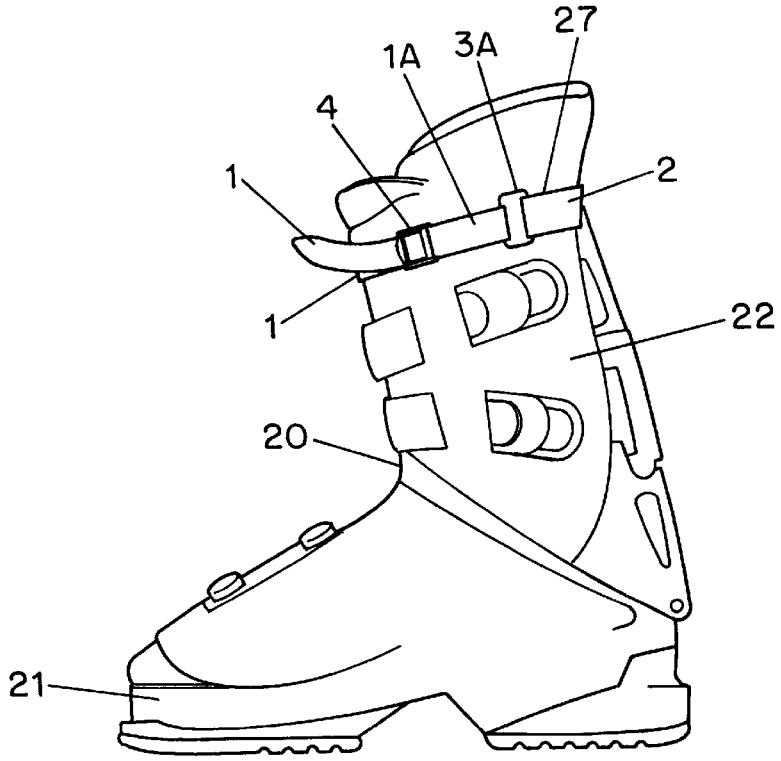
FIG. 2 is a left side view of the ski boot of the invention.
Figure 3:
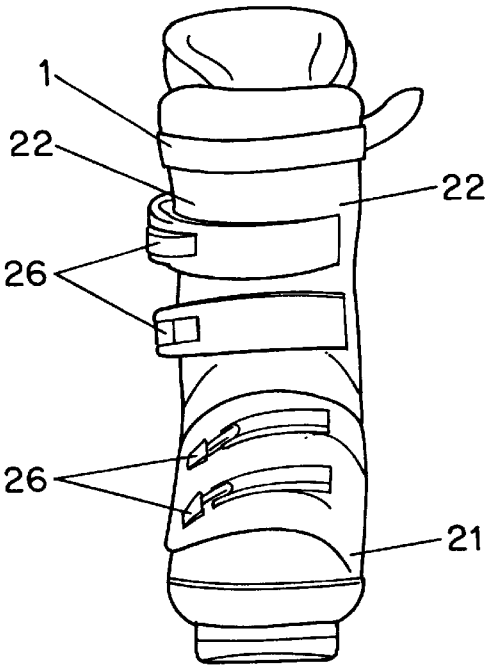
FIG. 3 is a front view of the ski boot of the invention.

As shown in FIGS. 1–5, the boot of the invention comprises a hard plastic shell 20 with a boot base 21 for accommodating the foot of the wearer. A soft inner bladder 23 is provided which fits inside the boot base of the shell part of which is made of a compressible material such as a closed cell foam. The shell includes an upper cuff portion 22 which encloses the lower leg of the wearer and is attached to the boot base 21. The rear portion of the upper cuff is sometimes called a rear spoiler. The upper cuff may be hinged to the boot base, as is common for front entry boots, or may be fixed to or part of the boot base.

Once the wearer's foot is inside the boot, fastening buckles 26 are tightened thereby applying pressure on the shell to the inner bladder. The pressure secures the boot to the foot and lower leg of the wearer. To complete the securing of the boot to the lower leg of the wearer the improved power strap 28 is tightened.

Figure 6:
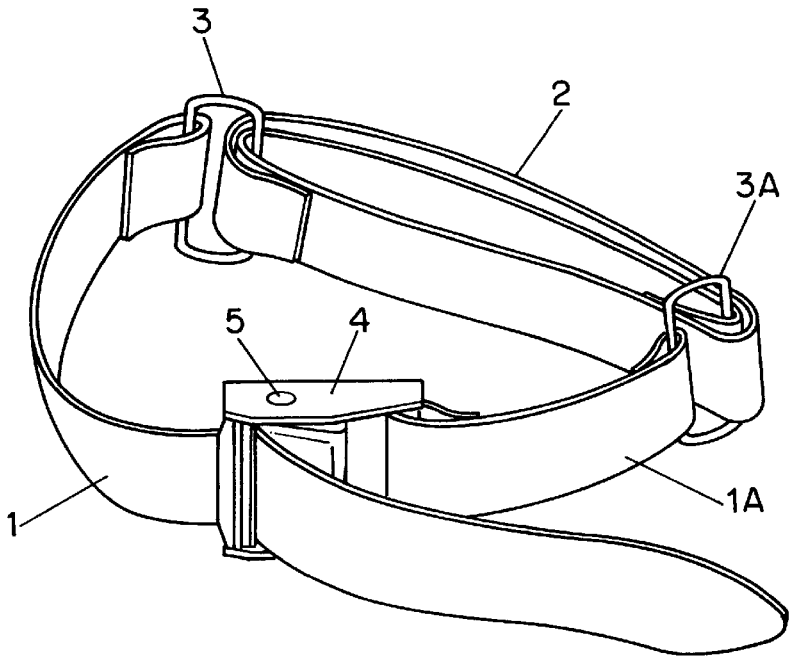
FIG. 6 is a perspective view of the strap used in the invention.
Figure 7:
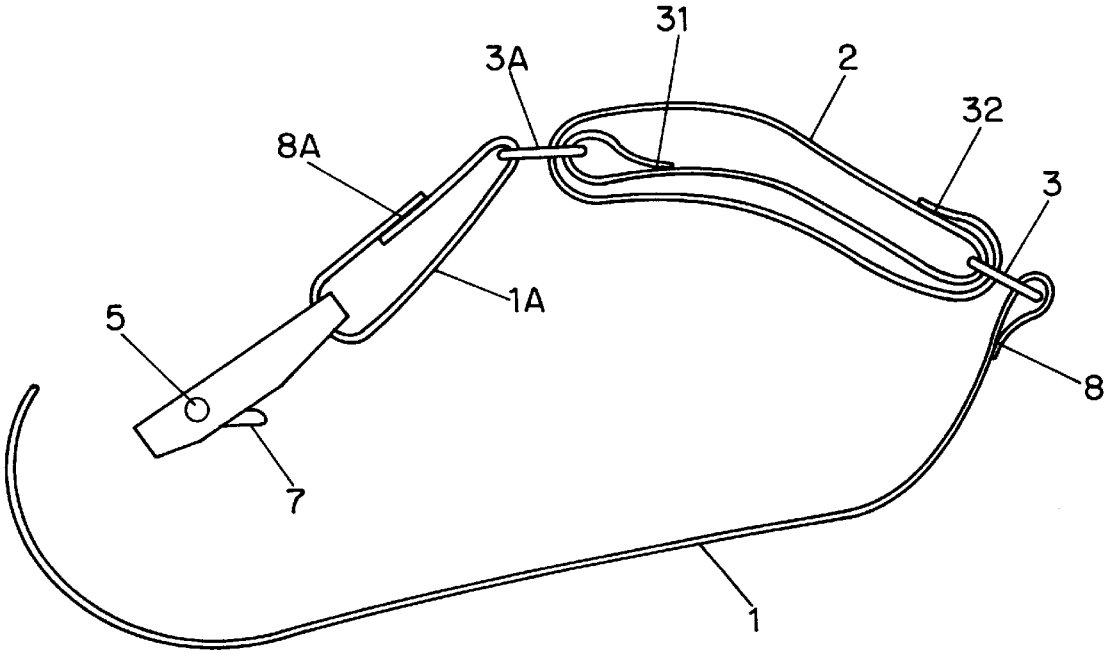
FIG. 7 is a top view of the strap used in the invention.
Figure 8:
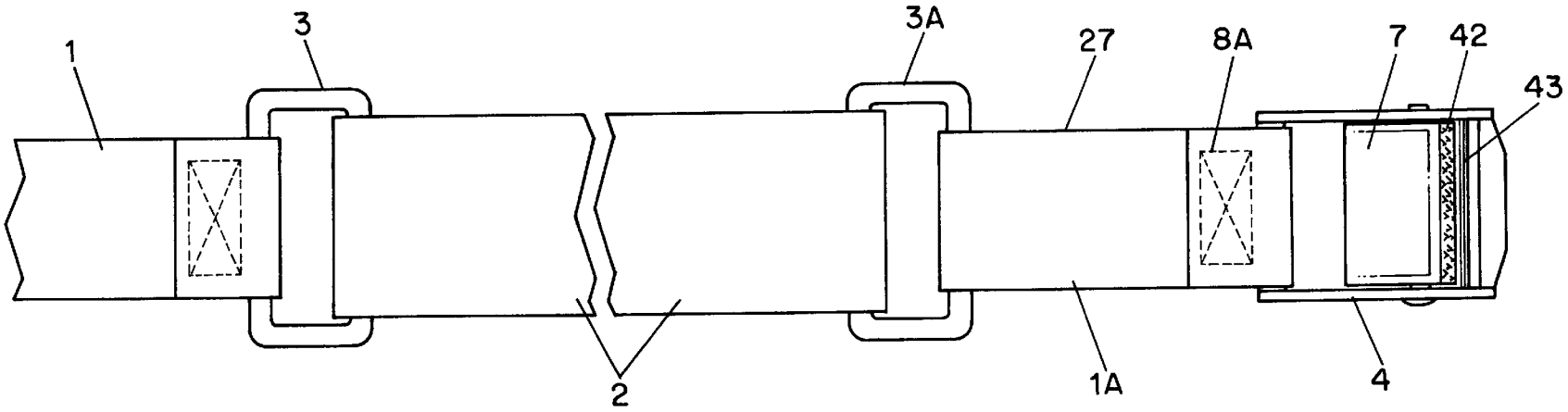
FIG. 8 is a side view of the strap used in the invention

As shown in FIGS. 6, 7 and 8, the improved power strap is made of a substantially non-elastic portions 1 and 1A. The non-elastic portions can be made of nylon webbing that is commonly used for ski boot power straps. Non-elastic portion 1 is attached to a first metal rectangular ring 3 by being looped though ring 3 and sewn to itself by stitching 8 which is similar to the stitching 8A. Similarly non-elastic portion 1A is looped through fastener 4 then through a second metal rectangular ring 3A and is secured by stitching 8A, thereby becoming attached to fastener 4 at one end and rectangular ring 3A at its other end.

Elastic band 2 stretches lengthwise and is looped through rectangular ring 3 and then through rectangular ring 3A. To add additional power, it is once again looped through rings 3 and 3A and fastened to itself by stitching 31 and 32 in a manner similar to stitching 8 and 8A thereby creating two loops. The elastic band can be provided with a buckle or fastening device so it can be easily removed from buckles 3 and 3A and replaced with an elastic band with a different elasticity. By providing a fastening device such as fastener 4 on the elastic band the amount of pressure exerted by the elastic band can be adjusted.

Fastener 4 is an example of a securing means for adjusting and securing the length of the power strap. Fastener 4 as shown is one such as is commonly used with nylon webbing lashing or tie-down straps. It is provided with a spring loaded lever 7 which pivots about pin 5 and has a rough friction creating surface 42. When the spring loaded lever is in a closed position it holds the non-elastic strap 1 securely in place by forcing it up against the end 43 of the fastener. When the spring loaded lever is pressed open, it relieves the pressure on non-elastic strap 1 thus allowing the wearer to adjust the tightness of the improved power strap.

Figure 4:
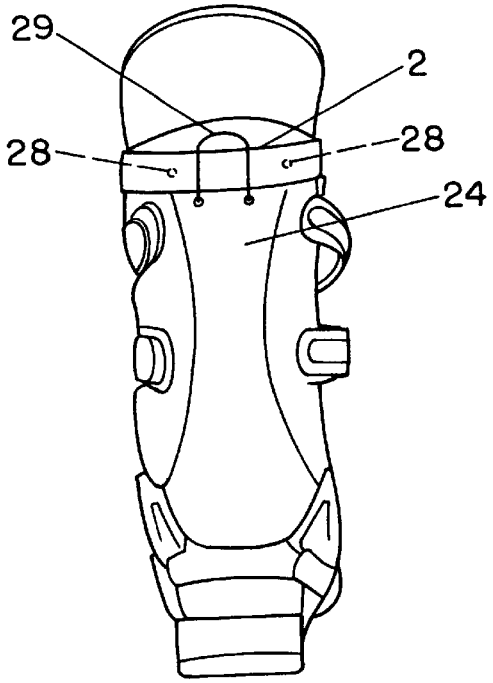
FIG. 4 is a rear view of the ski boot of the invention.
Figure 5:
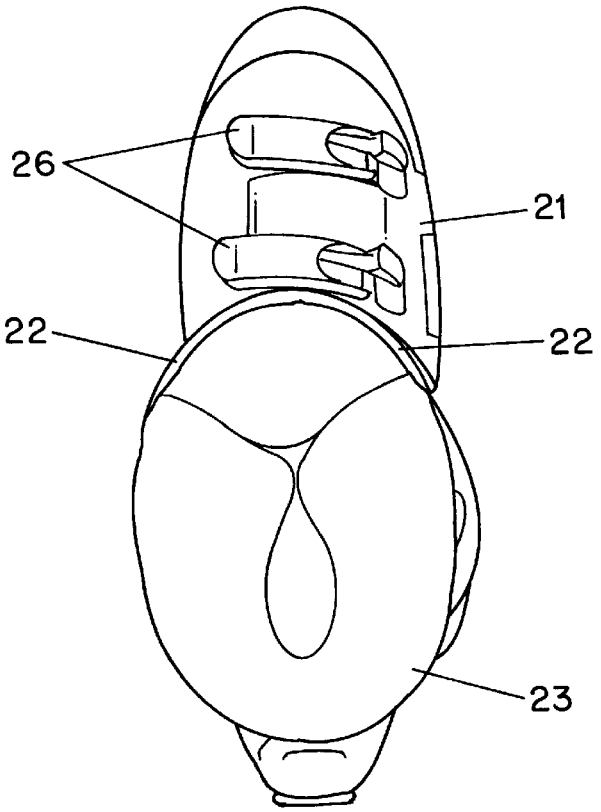
FIG. 5 is a top view of the ski boot of the invention.

The improved power strap may be held in place by back cuff clip 27 as shown in FIG. 4. It may also be fixed to the upper cuff by rivets 28 or some other form of attachment means. Rivets 28 go through only one loop of elastic band 2 when multiple loops are made as set forth above.

In another embodiment the securing means such as fastener 4 can be attached directly to the upper cuff instead of being part of the strap itself. In such case the power strap can be fixed to the upper cuff by a rivet going through non-elastic strap 1A, or if 1A is not part of the strap, then by a rivet going through elastic band 2. In another embodiment the securing means can also be attached to elastic band 2 eliminating the non-elastic strap 1A and ring 3A.

The improved power strap can also be applied to a snowboard binding such as that shown in FIG. 9 used with a soft snowboard boot. It such case the snowboard binding provides the upper cuff 91 and is attached to a boot base 92 which is actually part of the binding. In such case the snowboard boot is the soft inner liner and the improved power strap shown in FIGS. 6, 7 and 8 secures the upper cuff portion of the snowboard binding to the soft snowboard boot.

Once the wearers foot is placed in the boot, non elastic strap 1 is inserted into fastener 4 with lever 7 being held in an open position. Lever 7 is then released and the strap pulled to the desired tightness. The pulling of the strap stretches the elastic portion 2 and thus sets the amount of pre-loaded pressure to be exerted by the improved power strap.

It can thus be seen that the improved power strap provides a self-adjusting means for applying a constant pressure to the lower leg of the wearer by applying constant pressure to the upper cuff and the portion of the inner boot surrounding the lower leg of the wearer no matter how much said inner boot is compressed. It should now be understood that the improved power strap when tightened applies a pre-loaded force on the soft inner boot liner and the lower leg of the wearer. As the wearer moves forward and aft while the ski boot is firmly held in place by a ski binding, a relatively constant force is applied to the lower leg of the wearer. This allows the wearer to maintain a constant feeling for the pressure applied to the boot and through the boot to the ski. Being able to sense such pressure is essential for high performance skiing and ski racing where timing and forward pressure on the ski is essential.

It should also be understood that while the instant invention is especially applicable to ski boots, it can be applied to any sport boot with an outer shell and an inner liner, such as roller or ice skates, snowboard boots and the like.

It will thus be seen that the objects set forth above, among those made apparent from the preceding description, are efficiently attained and, since certain changes may be made in carrying out the above improved closure for a sport boot without departing from the spirit and scope of the invention, it is intended that all matter contained in the above description and shown in the accompanying drawings shall be interpreted as illustrative and not in a limiting sense.

It is also understood that the following claims are intended to cover all of the generic and specific features of the invention herein described, all statements of the scope of the invention which is a matter of language might be said to fall therebetween.

What is claimed is:

1. In a sport boot comprising:

a boot base for accommodating the foot of the wearer of the boot, a soft inner boot adapted to fit inside or on the boot base and surround the lower leg of the wearer of the boot; and an upper cuff attached to said boot base and having a rear portion surrounding the back of the lower leg of the wearer of the boot; the improvement comprising:

a closure strap for securing the upper cuff and soft inner boot to the lower leg of the wearer of the boot;

said strap comprising:

an elastic portion;

a non-elastic band attached to said elastic portion; and securing means for adjusting the length of the non-elastic band and securely maintaining the adjusted length of the non-elastic band in a desired position thereby pre-setting a relatively constant load to be applied to the rear portion of the upper cuff when the closure strap secures the upper cuff and the soft inner boot.

2. The sport boot of claim 1 wherein the securing means is attached to the closure strap.

3. The sport boot of claim 1 wherein the securing means is attached to the upper cuff.

4. The sport boot of claim 2 wherein the securing means is attached to the elastic portion of the closure strap.

5. The sport boot of claim 4 wherein said elastic portion of the closure strap has two ends and said non-elastic band is attached to one end, said closure strap further comprising a second non-elastic band attached to the other end of the elastic portion of the closure strap.

6. A ski boot comprising:

a boot base for accommodating the foot of the wearer of the boot;

a separate soft compressible inner boot adapted to fit inside or on the boot base and having a portion which is adapted to surround the lower leg of the wearer of the boot;

a rigid upper cuff attached to said boot base and having a rear portion surrounding the back of the lower leg of the wearer of the boot; and self-adjusting means for applying a constant pressure to the lower leg of the wearer by applying constant pressure to the upper cuff and the portion of the inner boot surrounding the lower leg of the wearer no matter how much said inner boot is compressed.

7. The sport boot of claim 6 wherein said self-adjusting means comprises:

a closure strap for securing the upper cuff and soft inner boot to the lower leg of the wearer of the boot;

said strap comprising:

an elastic portion; and a non-elastic band attached to said elastic portion;

and further comprising securing means for adjusting the length of the non-elastic band and securely maintaining the adjusted length of the non-elastic band in a desired position.

8. The sport boot of claim 7 wherein the securing means is attached to the closure strap.

9. The sport boot of claim 7 wherein the securing means is attached to the upper cuff.

10. The sport boot of claim 9 wherein the securing means is attached to the elastic portion of the closure strap.

11. The sport boot of claim 10 wherein said elastic portion of the closure strap has two ends and said non-elastic band is attached to one end, said closure strap further comprising a second non-elastic band attached to the other end of the elastic portion of the closure strap.

12. A method for securing a ski boot to the lower leg of the wearer of the sport boot wherein said sport boot comprises:

a boot base for accommodating the foot of the wearer of the boot;

a soft compressible inner boot adapted to fit inside or on the boot base and having a portion which is adapted to surround the lower leg of the wearer of the boot; and a rigid upper cuff attached to said boot base and having a rear portion surrounding the back of the lower leg of the wearer of the boot;

said method comprising surrounding said upper cuff with a self-adjusting means for applying a constant pressure to the lower leg of the wearer by applying constant pressure to the rear portion of the upper cuff and the portion of the inner boot surrounding the lower leg of the wearer no matter how much said inner boot is compressed.

13. The method of claim 12 wherein said self adjusting means comprises:

a closure strap for securing the hinged upper cuff and soft inner boot to the lower leg of the wearer of the boot;

said strap comprising:

an elastic portion; and a non-elastic band attached to said elastic portion;

and further comprising securing means for adjusting the length of the non-elastic band and securely maintaining the adjusted length of the non-elastic band in a desired position.

14. The method of claim 13 wherein the securing means is attached to the closure strap.

15. The method of claim 13 wherein the securing means is attached to the upper cuff.

16. The method of claim 15 wherein the securing means is attached to the elastic portion of the closure strap.

17. The method of claim 16 wherein said elastic portion of the closure strap has two ends and said non-elastic band is attached to one end, said closure strap further comprising a second non-elastic band attached to the other end of the elastic portion of the closure strap.

* * * * *